United States Patent [19]

Geen et al.

[11] Patent Number: 5,018,325

[45] Date of Patent: May 28, 1991

[54] SYSTEM AND METHOD FOR SHIELDING THE PERIPHERY OF A FRAMEWORK OF A BUILDING OPENING ADJACENT A BUILDING SURFACE

[76] Inventors: Oliver Geen, 1068 Briarhurst, Manchester, Mo. 63021; Cornelis G. Arens, 4247 White Birch Dr., W. Bloomfield, Mich. 48033

[21] Appl. No.: 587,774

[22] Filed: Sep. 24, 1990

[51] Int. Cl.[5] ..... E06B 1/04

[52] U.S. Cl. ..... 52/211; 52/212; 52/716

[58] Field of Search ..... 52/211, 212, 213, 215, 52/217, 716

[56] References Cited

U.S. PATENT DOCUMENTS

| | | | |
|---|---|---|---|
| 908,858 | 6/1908 | Goddard | 52/211 X |
| 4,189,885 | 2/1980 | Fritz | 52/716 X |
| 4,341,048 | 7/1982 | Minter | 52/716 X |
| 4,389,824 | 6/1983 | Anderson | 52/212 X |

*Primary Examiner*—Richard E. Chilcot, Jr.
*Assistant Examiner*—Kien T. Nguyen

[57] ABSTRACT

A facia system for shielding the periphery of the framework of a building opening adjacent a building surface including a first channel extending orthogonal to the building surface, a second channel extending parallel to the building surface and a facia having first and second planar portions joined together to define an L-shaped cross-section; wherein the facia has edges for insertion into the first and second channels.

15 Claims, 2 Drawing Sheets

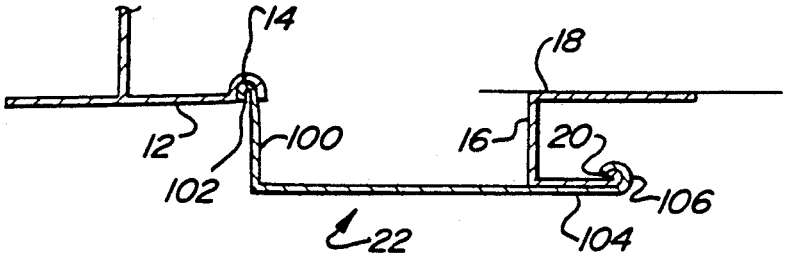
Fig-5
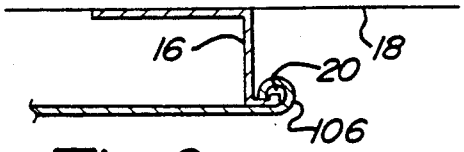
Fig-6
Fig-7
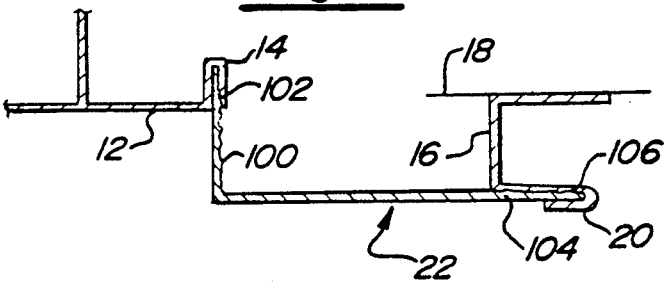
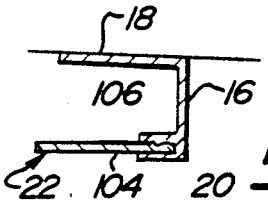
Fig-8
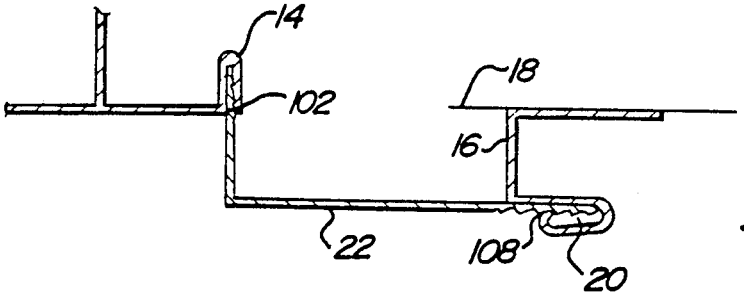
Fig-9
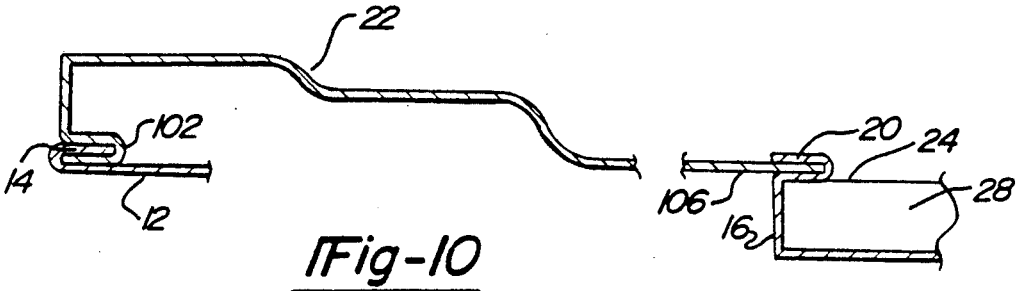
Fig-10

SYSTEM AND METHOD FOR SHIELDING THE PERIPHERY OF A FRAMEWORK OF A BUILDING OPENING ADJACENT A BUILDING SURFACE

BACKGROUND OF THE INVENTION

1. Field of the Invention

This invention relates to systems for covering the external surface of a building construction; and more particularly to an improved system for shielding openings left between portions of siding systems.

2. Description of the Related Art

The use of siding to protect the outside of a house is commonplace in new construction as well as renovation of existing structures. Such siding is generally made of aluminum, vinyl or steel and is attached to the external building surface. In order to complete the exterior covering of the building, various types of accessory moldings are required. For example, various types of moldings are needed at the corners, edges, adjacent the roof, and at various other interconnecting locations.

Typically, when finishing off a building opening, a J-channel is utilized. The J-channel is first secured around the opening with one portion of the channel being fastened directly to the exterior building surface. The joint left between the J-channel and the frame placed in the opening is then filled with a weatherproofing caulk. The joint then presents a continuous maintenance item as well as an aesthetically compromised appearance.

U.S. Pat. No. 4,341,048 discloses a technique for covering the peripheral gap between a frame placed in the building opening and the exterior surface of the building. The patent teaches a facia having two portions which are oriented orthogonal to one another. The outward edges of the portions are inserted into respective grooves. A first groove in the frame and a second groove in a receptor placed on the external building surface. A resilience imparted to the facia by the structure of the second groove maintains engagement of the facia in the first groove. The engagement of the facia in the first groove may be enhanced by application of a bead of caulk. Over the passage of time, weathering impairs the resilience of the system as well as the integrity of the caulk bead leading to possible leakage.

Therefore, there exists a need for a system for providing a shield for the periphery of a building opening which is resistant to weathering and does not require a caulk bead.

SUMMARY OF THE INVENTION

An exemplary embodiment of the present invention includes a facia system for shielding the periphery of the framework of a building opening adjacent a building surface including a first channel extending orthogonal to the building surface, a second channel extending parallel to the building surface and a facia having first and second planar portions joined together to define an L-shaped cross-section; wherein the facia has edges for insertion into the first and second channels. The second channel is formed as a utility combined with a J-channel.

The invention further includes a system for shielding an opening left between portions of a system covering the external surfaces of a building including a first member which defines an elongated linearly extending first channel. The first member has a closed interior portion defining part of the first channel and an elongated slotted opening which communicates with the first channel. The first member further includes a flange for maintaining the first channel in fixed relation to the framework in which the first channel is oriented in a predetermined manner with respect to the building surface. One manner of orientation is one in which the first channel is oriented substantially orthogonal to the building. The system further includes a second member which defines an elongated linearly extending second channel. The second member has a closed interior portion defining part of the second channel and an elongated slotted opening which communicates with the second channel. The second member further includes a flange for attaching the second member to the building surface thereby maintaining the second channel in fixed relation to the framework in which the second channel is oriented in a predetermined manner with respect to the building surface. The second member may be oriented substantially parallel to the building surface. Finally, the system includes a facia member having first and second planar portions. The first portion has an edge for slidable insertion into the slotted opening of the first member and the second portion has an edge for slidable insertion into the slotted opening of the second member. The facia thereby spans the periphery of the framework between the first and second members to provide a weather resistant cover. Further, the facia member having first and second planar portions joined together may define a generally L-shaped cross-section. In addition, the invention includes a third member which defines an elongated linearly extending third channel. The third member has a closed interior portion defining part of the third channel and an elongated slotted opening which communicates with the third channel. The third member further includes a flange means for maintaining the third channel in fixed relation to the framework in which the third channel is substantially orthogonal to the building surface and in which the elongated slotted openings of the first and third members converge at a predefined angle. The system further includes a fourth member which defines an elongated linearly extending fourth channel. The fourth member has a closed interior portion defining part of the fourth channel and an elongated slotted opening which communicates with the fourth channel. The fourth member further is secured to the building surface thereby maintaining the fourth channel in fixed relation to the framework in which the fourth channel is substantially parallel to the building surface and in which the elongated slotted openings of the second and fourth members converge at said predefined angle. The system also includes a second facia member having third and fourth planar portions joined together. The third portion has an edge for slidable insertion into the slotted opening of the third member and the fourth has an edge for slidable insertion into the slotted opening of the fourth member wherein the second and fourth planar portions overlap one another and the second facia member spans the periphery of the framework between the third and fourth members to provide a weather resistant cover. It is to be noted that the facia member having first and second planar portions joined together may define a generally L-shaped cross-section. The invention further includes a system wherein the second channel lies generally in a plane parallel to and outwardly of the building surface and wherein the slotted opening of the second member defines a gap. The second portion is sufficiently deformable such that the facia member will articulate about the slotted opening sufficiently to permit the slidable engagement of the first portion with the slotted opening of the first member. Further, the system, as described, features a first member having a closed end wherein the edge of the first portion of the facia member is spaced apart to permit thermal expansion. In addition, the closed end of the second member and the edge of the second portion of the facia member are spaced apart to permit thermal expansion. In addition, the system may include a first portion of the generally L-shaped cross-section including raised portions providing an enlarged cross-section which cooperates with the first channel to achieve mechanical interlock therebetween. In addition, the system includes a second member having an elongated linearly extending third channel wherein the second member has a closed interior portion defining part of the third channel and an elongated slotted opening which communicates with the third channel and the third channel is substantially parallel to the second channel and oriented in an opposing direction therefrom for receiving siding placed on the exterior surface of the building. The system may feature a first member which is separate from the framework and attachable thereto for retrofitting the existing building structures.

These and other aspects of the present invention will become more readily apparent by reference to the following detailed description of the embodiments as shown in the drawings.

BRIEF DESCRIPTION OF THE DRAWINGS

FIG. 5 is a cross-section of the facia system of the present invention incorporating rolled channels for interlocking the elements of the facia system;

FIG. 6 is a cross-section of the facia system shown in FIG. 5 for use on buildings without siding;

FIG. 7 is a cross-section of the facia system of the present invention incorporating frictionally interlocking channels for interlocking the elements of the facia system;

FIG. 8 is a cross-section of the facia system shown in FIG. 7 for use on buildings without siding;

FIG. 9 is a cross-section of the facia system of the present invention incorporating inverted frictionally interlocking channels for interlocking the elements of the facia system; and FIG. 10 is a cross-section of another embodiment of the present invention.

DESCRIPTION OF THE PREFERRED EMBODIMENT

Figure 4:
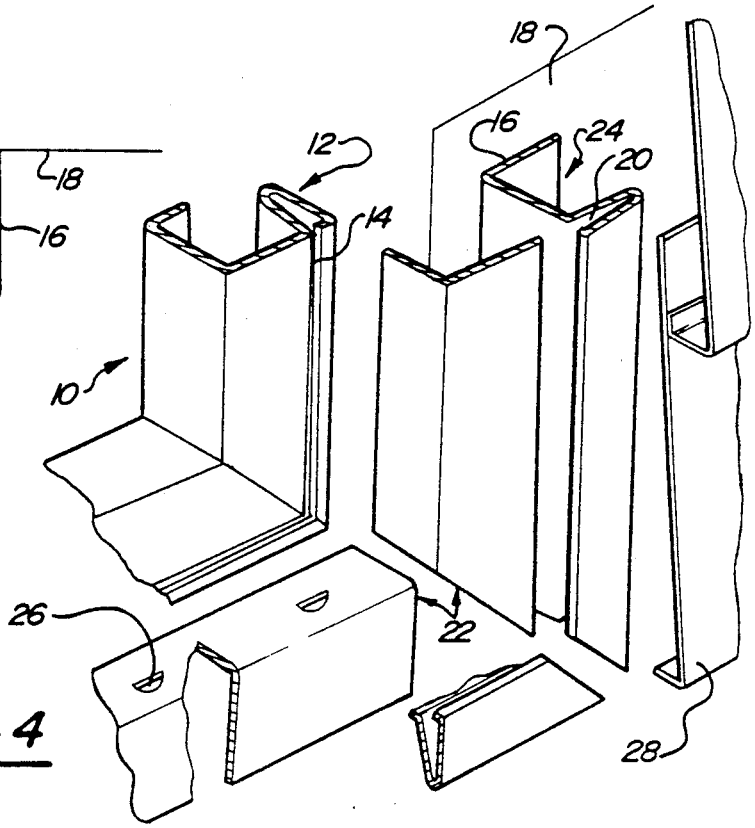
FIG. 4 is an exploded perspective view of the present invention.

The preferred embodiment of the present invention is shown in FIG. 4 including a finned window 10 having a first receptor 12 integrally formed therewith. The first receptor incorporates an open channel 14. A second receptor 16 secured to the outermost building surface 18 incorporates an open channel 20. A facia 22, including a first portion 100 featuring edge 102 and a second portion 104 featuring edge 106, is received in the channels 14, 20. Siding 28 covering the building surface 18 is received in opening 24 of receptor 16.

A NHPI Snaplock punch may be used to provide raised cross-sectional portions 26 in facia 22 to cooperate with channel 14 to retain the facia 22 therein.

The steps of assembly include;

(a) installing the finned window 10 including the first receptor 12;

(b) installing the second receptor 16 on the building surface 18;

(c) inserting a first edge of facia 22 into receptor 16; and (d) articulating facia 22 into locking engagement between raised cross-sectional portions 26 and receptor 12.

Figure 1:
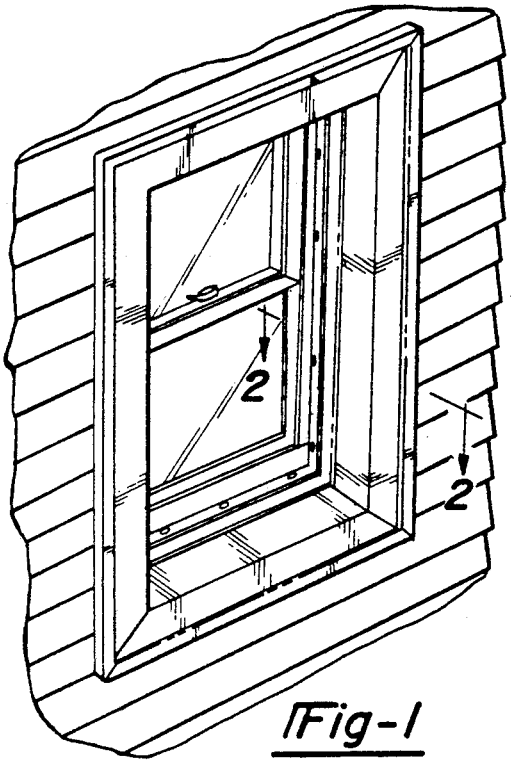
FIG. 1 is a perspective view of a building opening incorporating the facia of the present invention.
Figure 2:
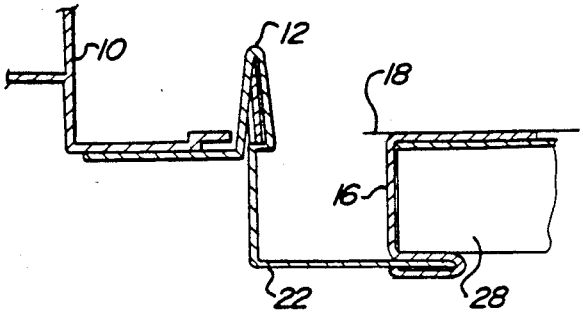
FIG. 2 is a cross-section of the facia system of the present invention taken along lines 2—2 of FIG. 1.

FIG. 2 illustrates the present invention as a retrofit to an existing window. That is, receptor 12 is shown as a separate member secured to the window 10 by conventional means including adhesive or equivalent fasteners (not shown).

Figure 3:
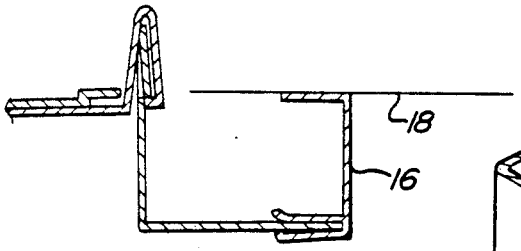
FIG. 3 is a cross-section of the facia system shown in FIG. 2 for use on buildings without siding.

FIG. 3 also represents the present invention as adapted to an existing window; however, receptor 16 is modified for installation abutting a building surface 18 which is not covered by siding.

FIGS. 5, 7 and 9 feature subsequent embodiments in which the channels 14, 20 are formed in a manner which cooperates with respective portions of facia 22 to complete mechanical interlock therebetween. The second embodiment disclosed in FIG. 5 includes a first receptor 12 having open channel 14 formed in a generally circular cross-sectional shape offering an opening less than 180 degrees wide. Facia 22 has a first portion 100 including an edge 102 which is rolled to present an outside diameter slightly greater than the width of the opening offered by channel 14. In this manner, facia 22 may be snapped into engagement with receptor 12 forming a strong mechanical connection therebetween as well as a weathertight, continuous seal. The opposite end of facia 22 includes a portion 104 which is also formed in a generally circular cross-sectional shape offering an opening less than 180 degrees wide. This opening is slightly smaller than the external dimension of portion 20 of receptor 16. Portion 20 is preferably of a circular shape.

The embodiment disclosed in FIG. 5 is assembled by first installing portion 106 of facia 22 over portion 20 of receptor 16. This achieves a strong mechanical interconnection therebetween which offers a weathertight continuous seal. Subsequently, facia 22 may be articulated about the axis of portion 20 thereby bringing portion 102 thereof into mechanical interlocking relation to channel 14. In this manner, a strong mechanical interlock may be achieved while providing a continuous weatherproof seal. A modification of this embodiment for use on buildings which do not incorporate siding on the external buildings surface is shown in FIG. 6.

The third embodiment disclosed in FIG. 7 incudes a receptors 12, 16 having an open chain 14, 20 offering constant width openings. Facia 22 having a first portion 100 with sawtooth shaped protrusions formed thereon provides ease of installation while resisting removal. In this manner, the facia 22 may be snapped into engagement with receptor 12 forming a strong mechanical connection therebetween as well as a weathertight, continuous seal. The opposite end of facia 22 includes a portion 104 which also features sawtooth shaped protrusions formed thereon.

The embodiment disclosed in FIG. 7 is assembled by first installing portion 106 of facia 22 into channel 20 of receptor 16. This achieves a strong mechanical interconnection therebetween which offers a weathertight continuous seal. Subsequently, facia 22 may be articulated about the axis of portion 20 thereby bringing portion 102 into engagement which channel 14.

In this manner, a strong mechanical interlock may be achieved while providing a continuous weatherproof seal. A modification of this embodiment for use on buildings which do not incorporate siding on the external building surface is shown in FIG. 8.

A modification to the third embodiment is shown in FIG. 9 including a receptor 16 having an open channel 20 including resiliently deformable portion 108 engaging the chip making portion of sawtooth shaped protrusions formed on facia 22. Assembly techniques are identical to that previously described with the exception that channel 20 imparts a continuous force which supplements the mechanical interlock of portion 102 of facia 22 in channel 14.

The embodiment disclosed in FIG. 10 includes a first receptor 12 having open channel 14. A second receptor 16 incorporates open channel 20. A facia 22 including edge 102, 106 is received in channels 14, 20. Siding 28 covering building surface 18 may be received in opening 24 of receptor 16. The embodiment disclosed in FIG. 10 is assembled by first installing edge 102 in channel 14. Next, facia 22 is elastically deformed permitting edge 106 to be installed in channel 20 of receptor 16.

One skilled in the art will readily recognize that certain specific details shown in the foregoing specification and drawings are exemplary in nature and subject to modification without departing from the teachings of the disclosure. Various modifications of the invention discussed in the foregoing description will become apparent to those skilled in the art. All such variations that basically rely on the teachings through which the invention has advanced the art are properly considered within the spirit and scope of the invention.

I claim:

1. A system for shielding an opening left between portions of a system covering the external surfaces of a building comprising:

a first member which defines an elongated linearly extending first channel, said first member having a closed interior portion defining part of said first channel and an elongated slotted opening which communicates with said first channel, said first member further having a flange means for maintaining said first channel in fixed relation to said framework in which said first channel is oriented in a predetermined manner with respect to said building surface;

a second member which defines an elongated linearly extending second channel, said second member having a closed interior portion defining part of said second channel and an elongated slotted opening which communicates with said second channel, said second member further having a flange means for attaching to said building surface thereby maintaining said second channel in fixed relation to said framework in which said second channel is oriented in a predetermined manner with respect to said building surface;

a facia member having first and second planar portions, said first portion having an edge for slidable insertion into said slotted opening of said first member and said second portion having an edge for slidable insertion into said slotted opening of said second member, said facia member thereby spanning the periphery of said framework between said first and second members to provide a weather resistant cover.

2. The system of claim 1 further comprising a facia member having first and second planar portions joined together to define a generally L-shaped cross-section.

3. The system of claim 1 wherein said first channel is oriented substantially orthogonal to said building surface.

4. The system of claim 1 wherein said second channel is oriented substantially parallel to said building surface.

5. The system of claim 1 further comprising:

a third member which defines an elongated linearly extending third channel, said third member having a closed interior portion defining part of said third channel and an elongated slotted opening which communicates with said third channel, said third member further having a flange means for maintaining said third channel in fixed relation to said framework in which said third channel is substantially orthogonal to said building surface and in which said elongated slotted openings of said first and third members converge at a predefined angle;

a fourth member which defines an elongated linearly extending fourth channel, said fourth member having a closed interior portion defining part of said fourth channel and an elongated slotted opening which communicates with said fourth channel, said fourth member further having a flange means for attaching to said building surface thereby maintaining said fourth channel in fixed relation to said framework in which said fourth channel is substantially parallel to said building surface and in which said elongated slotted openings of said second and fourth members converge at said predefined angle;

a second facia member having third and fourth planar portions joined together, said third portion having an edge for slidable insertion into said slotted opening of said third member and said fourth portion having an edge for slidable insertion into said slotted opening of said fourth member;

wherein said second and fourth planar portions overlapping one another and said second facia member spanning the periphery of said framework between said third and fourth members to provide a weather resistant cover.

6. The system of claim 2 further comprising a facia member having first and second planar portions joined together to define a generally L-shaped cross-section.

7. The system of claim 1 wherein said second channel lies generally in a plane parallel to and outwardly of said building surface and wherein said slotted opening of said second member defines a gap of sufficient size and said second portion is sufficiently deformable such that said facia member will articulate about said slotted opening of said second member sufficiently to permit the slidable engagement of said first portion with said slotted opening of said first member.

8. The system of claim 1 wherein said closed end of said first member and said edge of said first portion of said facia member are spaced apart to permit thermal expansion.

9. The system of claim 1 wherein said closed end of said second member and said edge of said second portion of said facia member are spaced apart to permit thermal expansion.

10. The system of claim 1 wherein said first portion of said generally L-shaped cross-section includes raised portions providing an enlarged cross-section which cooperates with said first channel to achieve mechanical interlock therebetween.

11. The system of claim 1 wherein said first, second and facia members are formed of extruded material.

12. The system of claim 11 wherein said extruded material is vinyl.

13. The system of claim 1 wherein said second member includes an elongated linearly extending third channel, said second member having a closed interior portion defining part of said third channel and an elongated slotted opening which communicates with said third channel and said third channel is substantially parallel to said second channel and oriented in an opposing direction therefrom for receiving siding placed on the exterior surface of said building.

14. The system of claim 1 wherein said first member is separate from said framework and attachable thereto for retrofitting existing building structures.

15. Method of installing a facia system for shielding the periphery of a framework of a building opening adjacent a building surface comprising the steps of:

installing a first member which defines an elongated linearly extending first channel in fixed relation to said framework in which said first channel is substantially orthogonal to said building surface;

installing a second member which defines an elongated linearly extending second channel on said building surface maintaining said second channel in fixed relation to said framework in which said second channel is substantially parallel to said building surface;

installing a first planar portion of a facia member in said second channel and articulating said second planar portion into engagement with said first channel of said first member thereby spanning the periphery of said framework between said first and second members to provide a weather resistant cover.

* * * * *